US007055821B1

(12) United States Patent
Huang

(10) Patent No.: US 7,055,821 B1
(45) Date of Patent: Jun. 6, 2006

(54) COIN ROLLING GAME APPARATUS

(75) Inventor: Sming Huang, Monmouth, NJ (US)

(73) Assignee: American Alpha Inc, Monmouth Junction, NJ (US)

( * ) Notice: Subject to any disclaimer, the term of this patent is extended or adjusted under 35 U.S.C. 154(b) by 652 days.

(21) Appl. No.: 10/267,362

(22) Filed: Oct. 9, 2002

(51) Int. Cl.
*A63B 7/00* (2006.01)

(52) U.S. Cl. ..... 273/138.3; 273/108; 273/118 R; 273/120 A; 273/126 R

(58) Field of Classification Search .. 273/138.2–138.4, 273/108, 118 R, 120 R, 120 A, 121 R, 121 A, 273/445, 114 R
See application file for complete search history.

(56) References Cited

U.S. PATENT DOCUMENTS

| | | | | |
|---|---|---|---|---|
| 4,240,536 | A * | 12/1980 | Noell, Jr. | 194/205 |
| 5,639,087 | A * | 6/1997 | Ogawa et al. | 273/109 |
| 5,667,217 | A * | 9/1997 | Kelly et al. | 273/126 R |
| 5,967,515 | A * | 10/1999 | Halliburton | 273/138.2 |
| 6,095,519 | A * | 8/2000 | Shoemaker, Jr. | 273/119 R |
| 6,390,471 | B1 * | 5/2002 | Shinbo et al. | 273/126 A |
| 6,520,500 | B1 * | 2/2003 | Pierce et al. | 273/108 |

* cited by examiner

*Primary Examiner*—Xuan M. Thai
*Assistant Examiner*—Alex F. R. P. Rada, II
(74) *Attorney, Agent, or Firm*—John Lezdey

(57) ABSTRACT

There is provided a gaming apparatus in which a player rolls a coin or token down a chute and across a playing field to a jackpot opening. The playing field has coin or token catches for a falling coin or token. The closer the coin or token gets to the jackpot opening the greater the reward. The chute may have obstacles to test the skill of the player.

11 Claims, 5 Drawing Sheets

COIN ROLLING GAME APPARATUS

FIELD OF THE INVENTION

The present invention relates to a gaming apparatus in which a player rolls a coin or token down a chute over a series of minor targets to an ultimate jackpot target at the end of the chute. The player can guide the coin or token onto the chute by moving a coin delivery means sideways and/or up and down. The game is scored by the number of coins which are placed in the target at the end of the chute and how far the coin or token advances without reaching the final target.

BACKGROUND OF THE INVENTION

A number of electronic gaming devices, including those commonly found in gaming casinos, include a visual display to provide an environment which encourages play of multiple rounds of the game to increase a player's interest, thus increasing the entertainment value which may increase the number of plays and add revenue to the casino or other game operator. However, many of the gaming apparatus, such as slot machines, cause reliance on luck and not on the skill of the player. In a slot machine the player inserts a coin and pulls a lever to spin reels that are electronically controlled. The player has no chance of using his skills in the operation of the game.

U.S. Pat. No. 5,511,794 to Katamoto, which is herein incorporated by reference, relates to a gaming apparatus having a revolving mechanism, a plurality of arms and a chute on which a coin or token is placed. Each arm contains a target and the chute brings the coin or token over a drop over the target. The game can be played by one or two players.

U.S. Pat. No. 5,326,108 to Faith discloses a game unit having a skill game coined with a prize dispenser; a coin toss gun shoots or tosses coins at a target.

U.S. Pat. No. 5,275,402 to Malavazos et al. disclose a coin game which is herein incorporated by reference. In the game, players drop coins onto a board through a chute which may swivel. The board is provided with a number of holes having different scoring values.

None of the prior coin games require the skill of the player to achieve a score, but the hand and eye coordination to provide a motivation for a player to improve.

It is understood that the term "coin or token" also includes chips and other disc-shaped game pieces.

SUMMARY OF THE INVENTION

The present invention provides a coin or token game having a playing field and a chute positioned over the playing field. The game is played by placing a coin or token on the chute and guiding the coin or token to a target wherein a jackpot is awarded. Along the playing field are minor targets into which the coin or token can fall so as to receive a score. The chute is associated with a coin or token delivery means, which is movable up and down and can be swiveled to either side to pass over said chute. The apparatus has a microprocessor for controlling the game and means associated with the microprocessor for storing a memory of each coin or token.

Advantageously, the apparatus has means responsive to programming the microprocessor in response to the skill level demonstrated by the player.

OBJECTS OF THE INVENTION

It is a general object of the invention to provide a coin or token rolling game, which provides a player with entertainment and rewards.

It is a further object to provide an apparatus wherein a coin or token is rolled on a chute over targets to test the skill of a player.

It is another object of the invention to provide a coin or token rolling gaming apparatus, which provides a visual and/or sound display when a target is reached.

The advantages and the objects of the invention will be better understood from a reading of the preferred embodiments together with the drawings.

DESCRIPTION OF THE PREFERRED EMBODIMENTS

Figure 1:
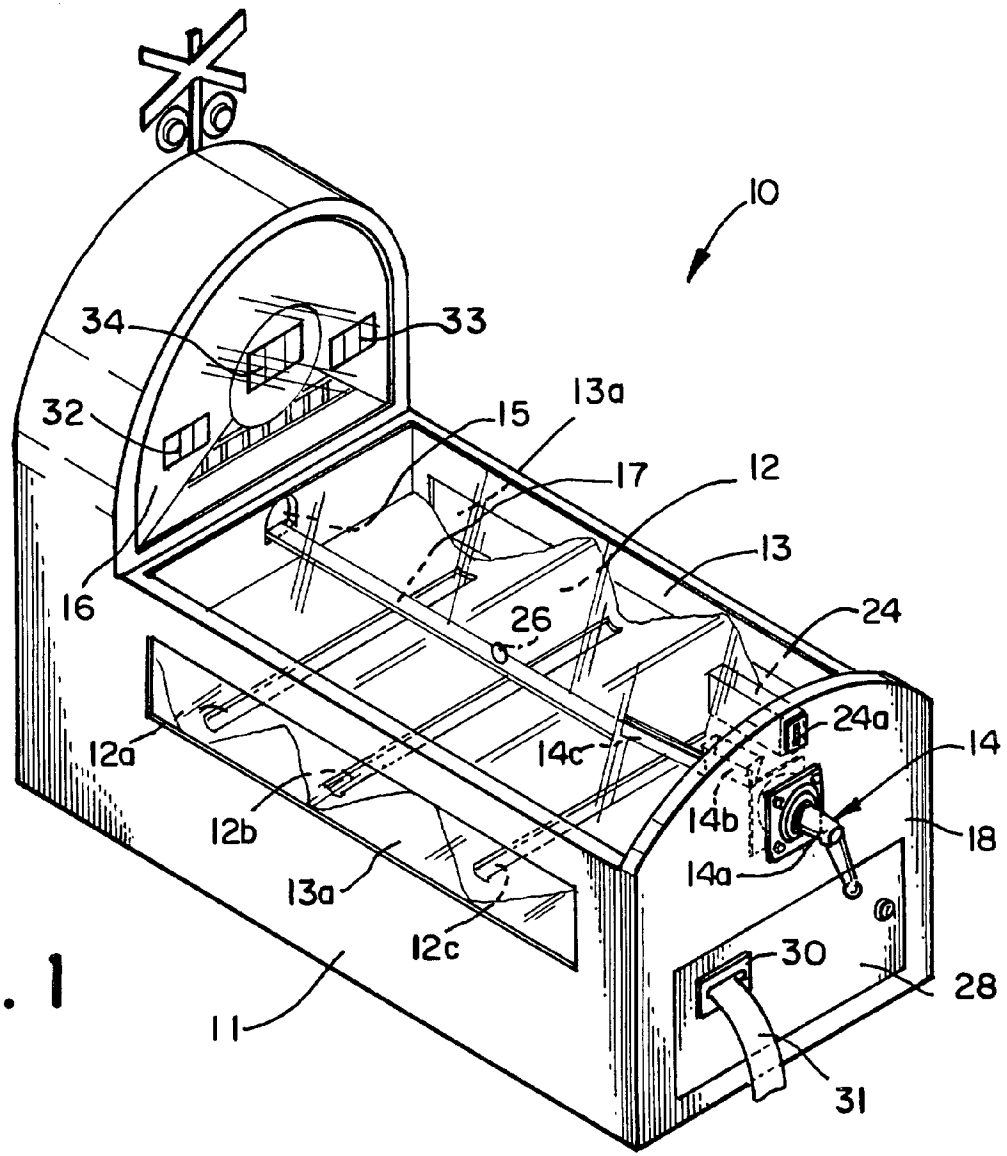
FIG. 1 is a perspective view partially in sections showing the gaming apparatus of the present invention.
Figure 2:
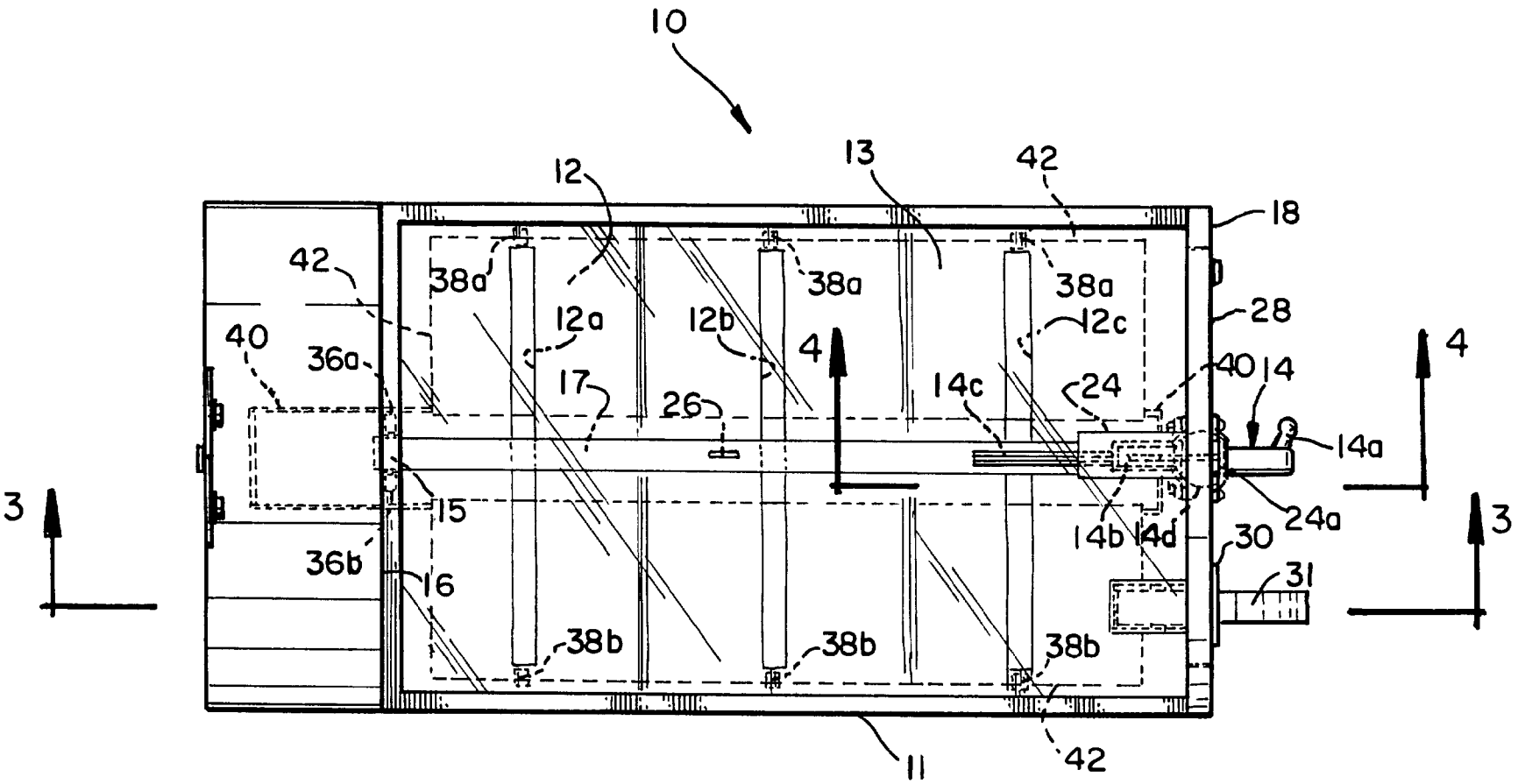
FIG. 2 is a top sectional view of the apparatus of FIG. 1.
Figure 3:
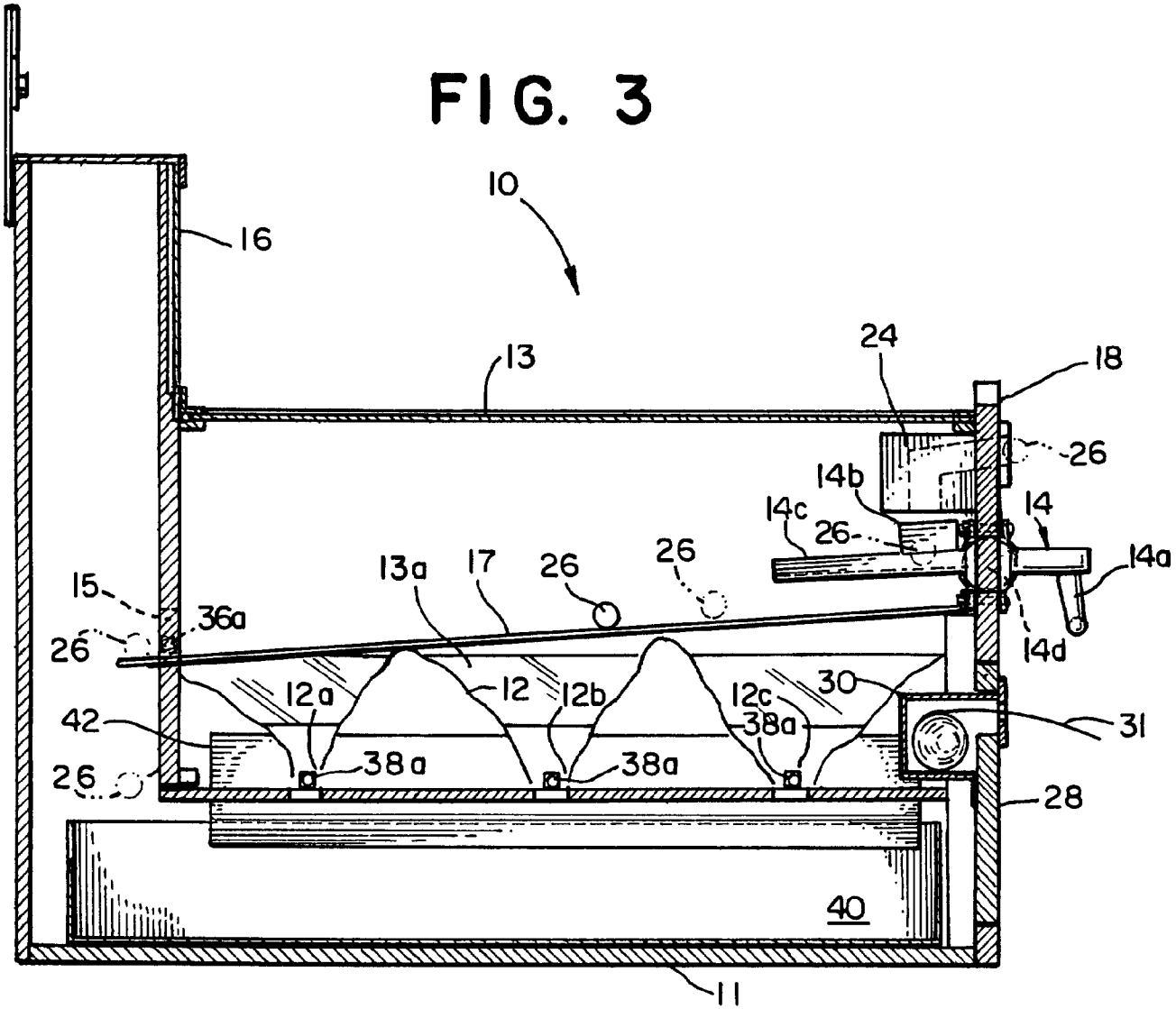
FIG. 3 is a side sectional view of the apparatus of FIG. 1.

As seen in FIGS. 1, 2, and 3, in the simplest form of the invention, there is provided a coin or token apparatus 10 comprising a housing 11 having an upper face 12, which forms the playing field. The playing field is conventionally covered by a transparent glass pane 13.

The housing 11 is defined by a rear portion 16, a front wall 18 and side walls.

Along the bottom of the rear portion 16, there is a slot 15, which contains sensors 36*a*,36*b* that can sense a coin or token entering the slot 15, which falls into a cash or token recovery box 40.

A coin or token roll chute 17 over the top of the playing field 12 is sloped so that the coin 26 by gravity rolls to the slot 15.

The chute 17 goes across the playing field 12 until it reaches the slot 15 of the apparatus. The slot 15 can be provided with a coin or token catch 40 and contains sensors 36*a*,36*b* which senses the coin or token 26 entering for a jackpot prize. If the slot 15 is stationary, only one opening 15 is needed. However, the rear portion may have a plurality of reciprocating openings (not shown) whereby different openings having different types of jackpots. In such a case, the opening can be a result of a revolving carousel having sensors to determine the type of jackpot.

The chute 17 extends over the playing field 12 from the coin or token 22 entry chute 14C to the slot 15 wherein the coin or token 26 drops into the jackpot slot 15.

The chute 14C can be moved manually by the player with knob 14 so as to control the passage of the coin or token 26 onto chute 17.

The chute 17 can contain obstacles such as dips and rises so as to require greater skill from the player. The dips and rises can be programmed into a microprocessor 34.

According to one embodiment, the chute 17 is suspended on a plurality of sloped walls 12 having slots 12A, 12B, 12C between each wall 12 with sensors 38A, 38B to sense a coin dropped into the slots 12A, 12B, 12C. The microprocessor 34 then records which slot was entered and shows a value on display 32,33.

Upon inserting a number of coins 26 into the slot 24*a* of coin receiver 24 prior to playing the game, a sensing means senses the coins inserted so as to provide pulse signals corresponding to the number of coins which are transmitted to and counted by a detection unit and a signal is sent to activate a control unit which provides a signal to the microprocessor 34 to activate the game.

In accordance with a further aspect of the invention, the chute 14C can be swiveled after the coin 26 drops between coin guide 14B. The chute 14C is attached to a pivot member 14D, which extends outside the housing 11 by a bar 14 having a handle 14A. A player controls the angle and slope of chute 14C to cause it to drop the coin 26 onto chute 17. The skill of the player in achieving the right slope will determine how the coin 26 travels to the slot 15.

The chute 17 may be provided with active and/or inactive bumps, which not only provide scoring but activates a video display or sound program. The coin or token 26, as it rolls down the inclined plane of the chute 17, can fall into targets or slots 12A, 12B, 12C, which are coin catchers. The closer the coin or token 26 rolls toward the slot 15, the greater is the score from the coin catcher.

The coin 26 travels downward from the coin slot toward the rear portion 16 so as to enter one of the jackpot slot 15 and activates one of the sensors. According to the game, initial failure to enter a jackpot slot either terminates the game or registers no score and permits further play. If the coin enters a jackpot slot, the CPU 34 senses the display and displays the cumulative score on displays 32, 33.

The projected images and sounds can be triggered by one or more targets, which are electrically connected with the CPU 34 to trigger an image or sound upon contact with the coin or token 26. There may be provided a projector (not shown), which comprises a cassette with an endless film, which cyclically produces an image on the displays. There is further the possibility to trigger image reproduction and sound or change when two or more targets have been hit, whether in a predetermined or random sequence.

Along the rear portion 16 there can be a plurality of lights, which flash when a coin enters the slot 15.

The display 32 can contain lights, which flash when a coin enters a catch 12A, 12B, 12C, which is activated to sense a coin or token 26 and provide a reward.

A ticket counter 30 is provided to count the number of tickets 31 won, which are dispensed from ticket box 28. A win ticket display 33 displays the number of tickets 31 won in a specific catch.

A jackpot display (not shown) can display the jackpot and provide a video and/or sound display to provide excitement to the game.

As illustrated in FIG. 3, the coin or token 26 rolls down the inclined chute 12 to the jackpot slot 15, which contains sensors 36A, 36B associated with the microprocessor 34. On route to the jackpot slot 15, the coin or token 26 may drop from the chute 17 into coin catch slots 12A, 12B, 12C, which contains sensors 38A, 38B that are associated with the microprocessor 34. The closer the coin or token gets to the jackpot slot 15 a reward is illustrated on the display 32. Optionally, there may be a catch 12C, which is a hazard and does not produce a reward by activating the sensor, which merely senses the presence of a coin 26.

The coins 26 are delivered to a coin box 40.

Figure 3A:
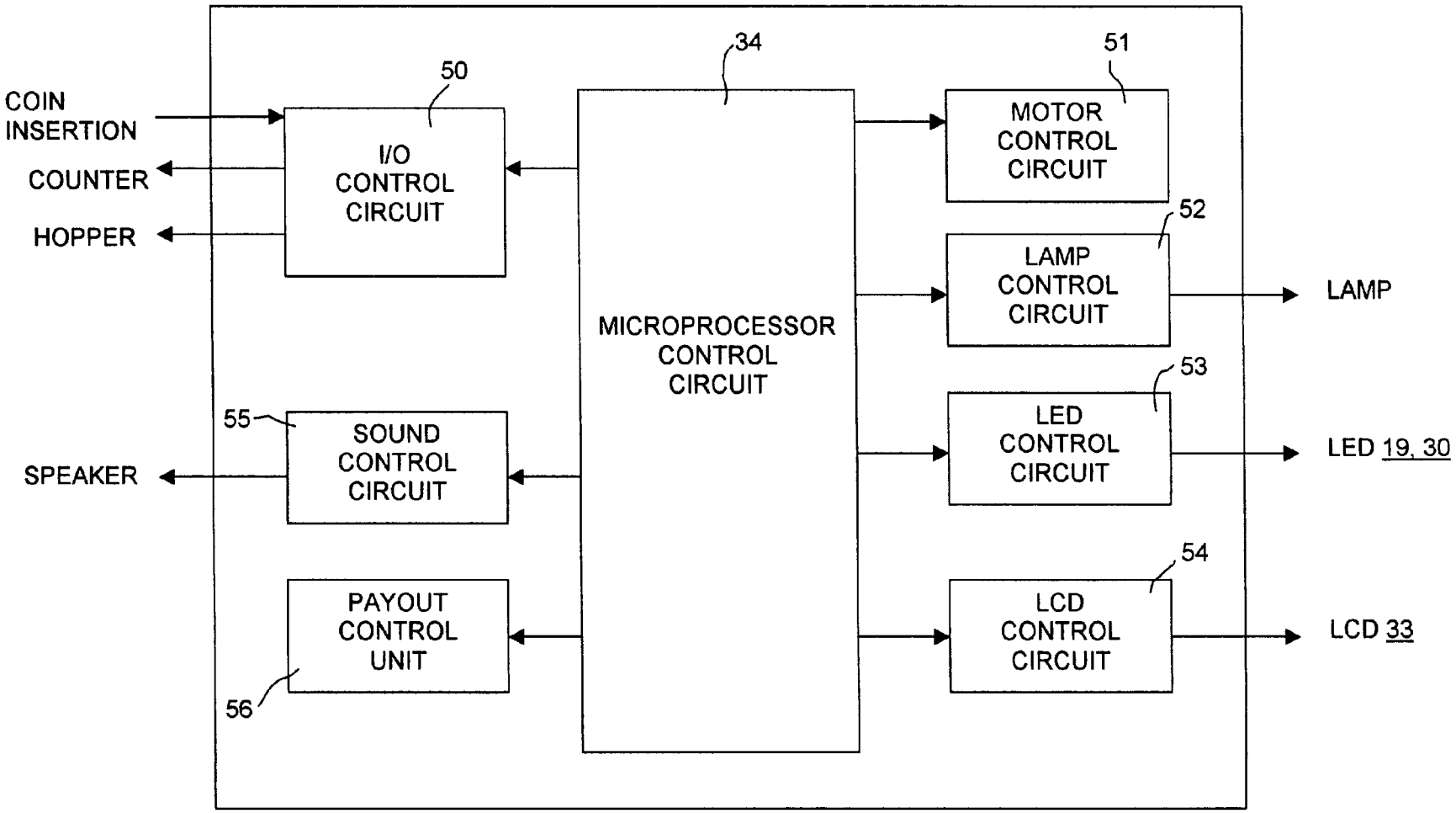
FIG. 3A is a block diagram depicting the function of the microprocessor.

FIG. 3A is a block diagram showing a configuration according to the present invention wherein a microprocessor or CPU 34 is a memory device in which every processing program is stored. CPU 34 controls the LCD display when coins are played or a jackpot is activated, a coin insertion and detection unit 60 for detecting the insertion of a coin 26 and includes a coin payout unit for paying out tickets or coins.

The CPU has a motor control unit 51 which controls the activation of the sensors, a lamp control unit 52 which illuminates the apparatus upon insertion of a coin, a LED control unit 53 for the LED's of the sensors and other illuminations, a LCD control unit 54 for the video display 33 of the jackpot indicator which also contains a graphic RAM for storing graphic data to be sent to the video display 32, 33 and a character ROM in which character data are stored, and a sound control unit 55 which stores sounds for different activities on the video display. A control circuit 50 senses the signals from the coin insert, counts the coins and senses where the coin drops.

The object of the game is to enter into a selected catch slot 15. Each catch is provided with a sensor which is associated with the microprocessor 34 that contains a program which activates or deactivates a sensor in one or more of the catches with each game so that the player would be required to alter his playing strategy with each game. In addition, the microprocessor 34 provides each catch with a value so that the same score will reflect the player's skill in being able to enter a given catch. The closer to the jackpot, the greater the reward.

Along the upper part of the housing 11 and at portion 16 is a display board 32, which is associated with a microprocessor 34 to provide the score and a visual display on screen 33 in accordance with the play on the playing field and the sensors activated by a coin or token 26. At least one sensor 36A, 36B provides a bonus score and is displaced by an LED. The microprocessor 34 is also programmed to deactivate a sensor 12C so that when the coin or token enters a deactivated catch 12C, the play is lost. The microprocessor 34 is further programmed to count the number of coins or tokens 26 which enter the chute 14C so that the odds are changed and the player must develop a different strategy. If the coin or token 26 fall into a catch, the sensor signals the microprocessor 34, which senses the display board and displays the cumulative score. Generally, there are at least three catches 12A, 12B, 12C on the playing field.

The game is played when a player inserts a coin or token 26 into the slot 24A. The coin or token 26 rolls down the inclined chute 12C toward a jackpot slot 15. The player, by manipulating a knob 14 can control the raising or lowering of the chute 14C to keep the coin or token 26 in play. The coin or token 26 can drop off the chute 17 into a coin catch 12A, 12B, 12C. The closer the coin or token 26 approaches the jackpot slot 15 the greater the reward. One or more coin catches can be provided to indicate a reward or as an obstacle to lose the play.

Lights may be provided to display the number of coins or tokens played or the entrance into a reward catch 15.

At the end of the chute 17 is the jackpot slot 15, which upon entry of a coin or slot 26 causes lights 19 to be activated.

The jackpot slot 15 can be associated with a carousel (not shown) having a catch of different jackpot values so that the player may control the timing of entry into the jackpot slot by manipulating the chute 14C with the knob 14A.

The knob 14A may also be the type, which swivels and throws the coin over the first slope so as to fall into active slot 12B.

The player may choose to continue to play based on the cumulative score or he may choose to pay out. The machine may be programmed to dispense tickets or coins. The addition of a coin or token lights up the playing field by a lamp (not shown).

Figure 4:
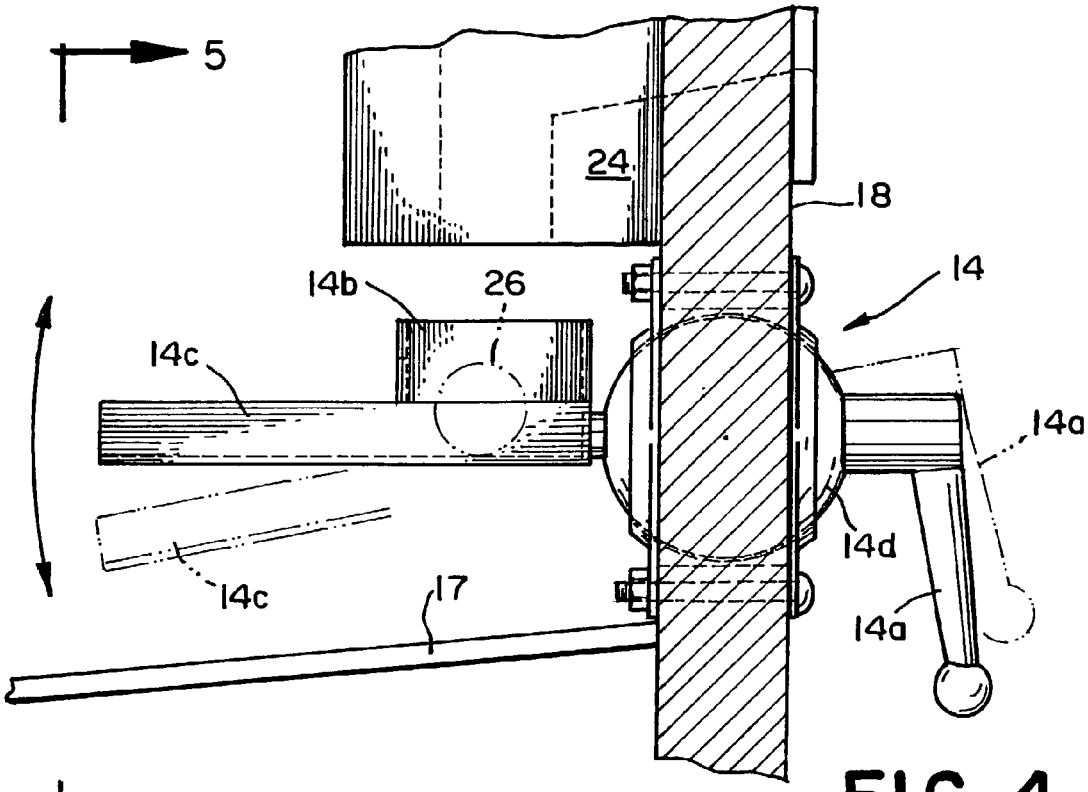
FIG. 4 is a perspective view partially in section of a system for delivering a coin to place it in play on the chute of the apparatus of FIG. 1.
Figure 5:
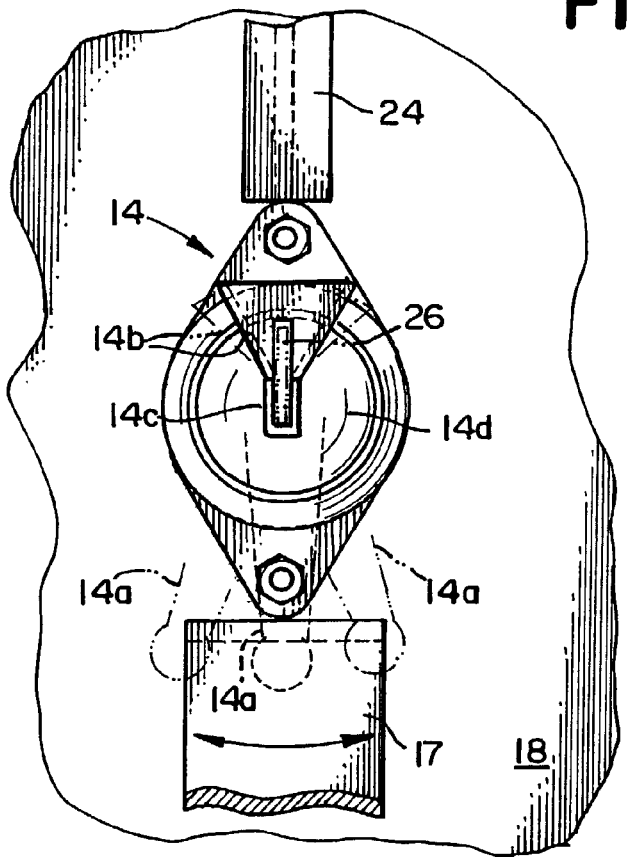
FIG. 5 is a front view partially in section of the coin delivery system of FIG. 4.

As shown in FIGS. 4 and 5, a coin or token 26 is placed into slot 24C or receiver 24, which is associated with a sensor to sense the microprocessor 34 of a coin or token being played. The coin or token 26 drops into coin delivery means 14 having a guide 14B, which is connected to a delivery channel 14C that delivers the coin or token 26 onto chute 17. Chute 17 generally has side walls, between which the coin or token drops. The channel 14C is connected to a pivot member 14D, which is fixed to the wall 18. The channel member 14C extends outwardly and has a handle or knob 14C for manually manipulating the direction of the channel.

While the invention is susceptible to various modifications and alternative forms, specific embodiments thereof have been shown by way of example in the drawings and will herein be described in detail. It should be understood, however, that it is not intended to be limited to the particular embodiments shown, but on the contrary, the intention is to over all modifications, equivalents and alternative falling within the spirit and scope of the appended claims.

What is claimed is:

1. A coin or token game apparatus comprising a housing having a coin slot, a playing field having a plurality of targets and a chute positioned over said playing field for receiving a coin or token from said slot which is placed on the chute and which coin or token rolls on said chute across the playing field, to guide the coin to a target at the end of the chute, a delivery means controllable by a player to deliver said coin or token from said slot to said chute and to control travel of said coin to a target at the end of said chute, said playing field comprising a plurality of peaks and valleys which contain sensors which detect a coin and signal the distance advanced by said coin or token which falls from said chute.

2. The apparatus of claim 1 wherein said delivery means has a coin or token guiding channel having a configuration which positions coins or tokens in an upright orientation on said chute and to cause a rolling motion of said coin or token on said chute toward said target at the end of said chute.

3. The apparatus of claim 1 wherein said delivery means comprises a slot for receiving a coin or token, a channel which receives said coin or token and delivers said coin or token onto said chute, and means for controlling the direction of said channel to deliver said coin or token onto said chute.

4. The apparatus of claim 1 including microprocessor means for controlling said game, means associated with said microprocessor for storing a memory of each coin and the disposition thereof, and means responsive to programming said microprocessor for controlling a pay-off by said game machine in response to the skill level demonstrated by a player dropping coins or tokens onto said chute.

5. The apparatus of claim 4 including means for storing a memory of a successful drop onto a target having a pay-out, and means responsive to said stored memory for giving a predetermined payout based on the skill of the player as demonstrated by the target and the number of coins received by a target.

6. The apparatus of claim 1 wherein each target comprises a sensor for registering a successful entry into said target.

7. The apparatus of claim 1 including a display device coupled to said microprocessor configured to display at least one of a plurality of indicators.

8. A coin or token game apparatus for playing by a player comprising a housing having a front wall, a back wall, side walls and a playing field, a) said rear wall having a target;

b) said front wall having a slot for receiving a coin or token;

c) a chute positioned above and across said playing field for delivering said coin or token to said target;

d) slanted delivery means comprising a channel for receiving said coin or token from said slot and delivering said coin or token onto said chute;

e) means associated with said delivery means which enables a player to control the direction of said channel, and f) a microprocessor responsive to said coin or token for controlling said game, said microprocessor being programmed to provide a pay-off when a token or coin reaches said target, said playing field comprises a plurality of peaks and valleys which contain sensors which detect a coin and signal said microprocessor on the distance advanced by said coin or token which falls from said chute.

9. The apparatus of claim 8 wherein said delivery means comprises a guide for guiding said coin or token from said slot onto a channel for delivering said coin or token from said slot to said chute.

10. The apparatus of claim 9 wherein said delivery means includes means for controlling the direction of said channel.

11. The apparatus of claim 8 including display means for displaying at least one of a plurality of indicators, said display means being associated with said microprocessor.

* * * * *